US007958796B2

(12) United States Patent
Hsu et al.

(10) Patent No.: US 7,958,796 B2
(45) Date of Patent: Jun. 14, 2011

(54) SCREW-DRIVEN FAN DEVICE

(75) Inventors: Edward Hsu, Taichung (TW); Wen-Chia Wu, Taichung (TW)

(73) Assignee: Hiwin Technologies Corp., Taichung (TW)

( * ) Notice: Subject to any disclaimer, the term of this patent is extended or adjusted under 35 U.S.C. 154(b) by 359 days.

(21) Appl. No.: 12/269,786

(22) Filed: Nov. 12, 2008

(65) Prior Publication Data

US 2010/0116470 A1 May 13, 2010

(51) Int. Cl.

| | |
|---|---|
| ***F16H 3/06*** | (2006.01) |
| ***F16H 27/02*** | (2006.01) |
| ***F16H 29/02*** | (2006.01) |
| ***F16H 29/20*** | (2006.01) |
| ***F16H 57/04*** | (2010.01) |

(52) U.S. Cl. ..... 74/89.23; 74/606 A

(58) Field of Classification Search ..... 415/131; 411/172, 418; 56/12.7, 17.5; 74/89.23, 89.34, 74/424.71, 606 A; 446/236, 241

See application file for complete search history.

(56) References Cited

U.S. PATENT DOCUMENTS

| | | | | | |
|---|---|---|---|---|---|
| 1,406,633 | A | * | 2/1922 | Frisk | 102/397 |
| 2,040,504 | A | * | 5/1936 | Siegel | 416/207 |
| 2,100,994 | A | * | 11/1937 | Cohen | 415/121.2 |
| 2,166,530 | A | * | 7/1939 | Morgan | 417/200 |
| 2,201,436 | A | * | 5/1940 | Jones, Jr. | 172/375 |
| 2,327,656 | A | * | 8/1943 | Meek | 285/202 |
| 2,335,744 | A | * | 11/1943 | Curtis | 403/259 |
| 2,706,468 | A | * | 4/1955 | Willcox | 123/41.11 |
| 2,827,989 | A | * | 3/1958 | Christenson | 192/3.34 |
| 2,837,069 | A | * | 6/1958 | Nutt | 123/41.12 |
| 3,189,075 | A | * | 6/1965 | Jobe | 411/272 |
| 3,415,435 | A | * | 12/1968 | Bevis | 226/102 |
| 3,455,102 | A | * | 7/1969 | Wolf | 368/73 |
| 3,711,218 | A | * | 1/1973 | Kennel et al. | 415/131 |
| 3,721,264 | A | * | 3/1973 | Coughlin | 137/596.2 |
| 3,963,382 | A | * | 6/1976 | Patton | 417/361 |
| 4,623,277 | A | * | 11/1986 | Wayne et al. | 403/314 |
| 4,633,938 | A | * | 1/1987 | Schunck et al. | 165/47 |
| 4,671,740 | A | * | 6/1987 | Ormiston et al. | 416/241 B |
| 4,697,746 | A | * | 10/1987 | Nishimori | 241/46.017 |
| 4,752,183 | A | * | 6/1988 | Sakurai | 415/12 |
| 5,080,624 | A | * | 1/1992 | Brinker | 446/48 |
| 5,182,146 | A | * | 1/1993 | O'Hara | 428/31 |
| 5,431,340 | A | * | 7/1995 | Schirpke et al. | 237/12.3 B |
| 5,448,944 | A | * | 9/1995 | Line et al. | 100/88 |
| 5,533,794 | A | * | 7/1996 | Faison | 301/105.1 |
| 5,660,367 | A | * | 8/1997 | Rush | 248/674 |
| 5,713,708 | A | * | 2/1998 | Van derDrift et al. | 411/208 |

(Continued)

FOREIGN PATENT DOCUMENTS

| | | |
|---|---|---|
| JP | 63-1956 | 1/1988 |

(Continued)

*Primary Examiner* — Richard W Ridley
*Assistant Examiner* — Adam D Rogers
(74) *Attorney, Agent, or Firm* — Chun-Ming Shih

(57) ABSTRACT

A screw-driven fan device includes a screw, a screw nut, a fan, and a connecting unit. An external edge of the screw has a rolling groove formed thereon and a groove formed alternately with the rolling groove. The screw nut, disposed on the screw, has a linking portion. The fan has a rotary axle with a hole formed thereon for screw passing through. The fan further has blades surrounding the rotary axle. The hole has a flange formed on an interior side thereof and engaged with the groove. The connecting unit has a space therein such that the fan can be placed in the space.

5 Claims, 4 Drawing Sheets

U.S. PATENT DOCUMENTS 5,800,120 A * 9/1998 Ramsay ..... 415/129
5,836,800 A * 11/1998 Liu ..... 446/236
5,967,135 A * 10/1999 Shariat ..... 126/275 R
5,967,751 A * 10/1999 Chen ..... 416/93 A
6,196,803 B1 * 3/2001 Hill et al. ..... 416/244 R
6,364,605 B1 * 4/2002 Lutes ..... 415/111
6,386,844 B1 * 5/2002 Chen et al. ..... 417/423.15
6,398,835 B1 * 6/2002 Rehil ..... 55/471
6,464,034 B1 * 10/2002 Toda et al. ..... 180/444
6,476,978 B2 * 11/2002 Takahashi ..... 359/704
6,533,559 B2 * 3/2003 Hsieh ..... 417/423.5
6,562,206 B2 * 5/2003 Showcatally ..... 204/280
6,651,775 B2 * 11/2003 Bassett, Jr. ..... 182/69.5
6,669,439 B2 * 12/2003 Kardasz et al. ..... 415/131
6,732,680 B1 * 5/2004 Beltramo et al. ..... 123/41.44
6,761,080 B2 * 7/2004 Lange et al. ..... 74/89.37
6,837,677 B2 * 1/2005 Zhang et al. ..... 415/174.3
6,880,676 B2 * 4/2005 Tsukada et al. ..... 184/5
6,893,213 B1 * 5/2005 Quill et al. ..... 415/131
7,014,420 B2 * 3/2006 Chang ..... 415/121.2
7,029,218 B2 * 4/2006 Peterkort ..... 411/198
7,104,753 B2 * 9/2006 Eubank et al. ..... 415/121.2
D532,097 S * 11/2006 Hidalgo et al. ..... D23/377
7,165,857 B2 * 1/2007 Fong ..... 362/35
7,172,477 B1 * 2/2007 Rollins ..... 440/71
7,223,076 B2 * 5/2007 Mansson ..... 416/204 R
7,229,331 B2 * 6/2007 Norman et al. ..... 440/71
7,267,300 B2 * 9/2007 Heath et al. ..... 244/12.3
7,281,965 B2 * 10/2007 Torres ..... 446/250
7,282,673 B2 * 10/2007 Sung et al. ..... 219/400
7,762,752 B2 * 7/2010 Kato ..... 411/386
7,841,250 B2 * 11/2010 Eberlein et al. ..... 74/89.23
2001/0031202 A1 * 10/2001 Nowack ..... 415/206
2002/0148236 A1 * 10/2002 Bell ..... 62/3.3
2002/0179429 A1 * 12/2002 Showcatally ..... 204/196.1
2003/0148675 A1 * 8/2003 Saunders ..... 440/67
2003/0167867 A1 * 9/2003 Lange et al. ..... 74/89.37
2004/0070983 A1 * 4/2004 Li et al. ..... 362/363
2004/0182073 A1 * 9/2004 Johnson ..... 60/363
2005/0016305 A1 * 1/2005 Lardy et al. ..... 74/89.42
2005/0051540 A1 * 3/2005 Ekinge et al. ..... 219/681
2005/0066874 A1 * 3/2005 Tonokaboni et al. ..... 114/361
2005/0111984 A1 * 5/2005 Hodowanec ..... 416/204 R
2005/0233674 A1 * 10/2005 Torres ..... 446/236
2006/0073018 A1 * 4/2006 Girod et al. ..... 416/146 R
2006/0133856 A1 * 6/2006 Deguchi et al. ..... 399/262
2006/0166571 A1 * 7/2006 Norman et al. ..... 440/66
2006/0192046 A1 * 8/2006 Heath et al. ..... 244/12.3
2006/0289531 A1 * 12/2006 Sin ..... 219/757
2007/0092375 A1 * 4/2007 Liu ..... 416/63
2007/0095813 A1 * 5/2007 Sung et al. ..... 219/400
2009/0035149 A1 * 2/2009 Sun et al. ..... 416/244 R
2009/0104037 A1 * 4/2009 Kellermann et al. ..... 416/204 R
2010/0006271 A1 * 1/2010 Wang ..... 165/121

FOREIGN PATENT DOCUMENTS

JP 3721264 11/2005
JP 2010144848 A * 7/2010

* cited by examiner

SCREW-DRIVEN FAN DEVICE

BACKGROUND OF THE INVENTION

1. Field of the Invention

The present disclosure is generally related to screw-driven fan devices and, more particularly, is related to fans, which are driven while rotating a screw to cause cooling effect on screw nut without additional power for rotating the fan device.

2. Description of the Prior Art

The conventional screw cooling technology is disclosed by Japan utility model publication No. S63-001956. The screw is provided with a cooling path, and the screw nut seat also has a cooling path thereon such that a cooling circulation path is formed by the cooling paths of the screw and the screw nut seat. The cooling circulation path, however, is complicatedly designed, and a cooling circulation passage must be formed on the screw seat, thereby increasing manufacturing cost. The manufacturing procedure is time-consuming. Thus, if the manufacturing procedure can be simplified, manufacturing cost can be minimized. Obviously, the conventional design still has to be improved to solve the problem mentioned above.

As disclosed by another Japan patent No. 3721264, in the conventional design, each of the screw, screw nut, motor mount is provided with cooling path acting like a cooling circuit. The cooling method is performed by a cooling liquid temperature-adjusting device, which is used for exchanging cool and hot temperature to achieve cooling effect. However, while using the cooling liquid of the conventional design for cooling purpose, if sealing mechanism is broken down, the cooling liquid would overflow, causing environmental problem. Thus, if other cooling source can be utilized, the environmental pollution can be avoided. Obviously, the conventional design must be improved.

As a result, based on the disadvantage and deficiency of the conventional designs, the inventor of the application continues to improve the design by a long-term research and development. Finally, a screw-driven fan device of the present invention is successfully developed.

SUMMARY OF THE INVENTION

Example embodiments of the present disclosure provide screw-driven fan devices, by rotating the screw for driving the fan. Thus, when the screw is operated, the fan can provide cooling effect.

Another object of the present invention is to provide a screw-driven fan device, in which rotating the screw generates the rotational power of the fan. Thus, a supplemental power source is not necessary, thereby eliminating additional circuit design and reducing power consumption.

Yet another object of the present invention is to provide a screw-driven fan device, wherein the fan is inserted into an interior of the screw such that while the screw rotates, the fan is driven. No matter how the screw nut is operated, the fan still can efficiently dissipate heat.

Further another object of the present invention is to provide a screw-driven fan device, in which the fan provides a cooling mechanism while reduces the complexity of the cooling passage design without contamination problem due to cooling liquid.

To achieve the forehand screw-driven fan device, the screw-driven fan device comprises a screw, a screw nut, a fan, and a connecting unit. An external edge of the screw has a rolling groove formed thereon and a groove formed alternately with the rolling groove. The screw nut, disposed on the screw, has a linking portion located on one end of the screw nut. The fan has a rotary axle with a hole formed thereon for screw passing through. The fan further has blades surrounding the rotary axle. The hole has a flange formed on an interior side thereof, and the flange is engaged with the groove. When the screw rotates, the coordination of the flange and the groove causes the fan rotates simultaneously. The connecting unit has one side mounted on the linking portion of the screw nut. The connecting unit has a space therein such that the fan can be placed in the space, thereby the fan and the screw nut move together. When the screw rotates, the fan is rotated simultaneously, and heat can be greatly dissipated from the screw nut.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
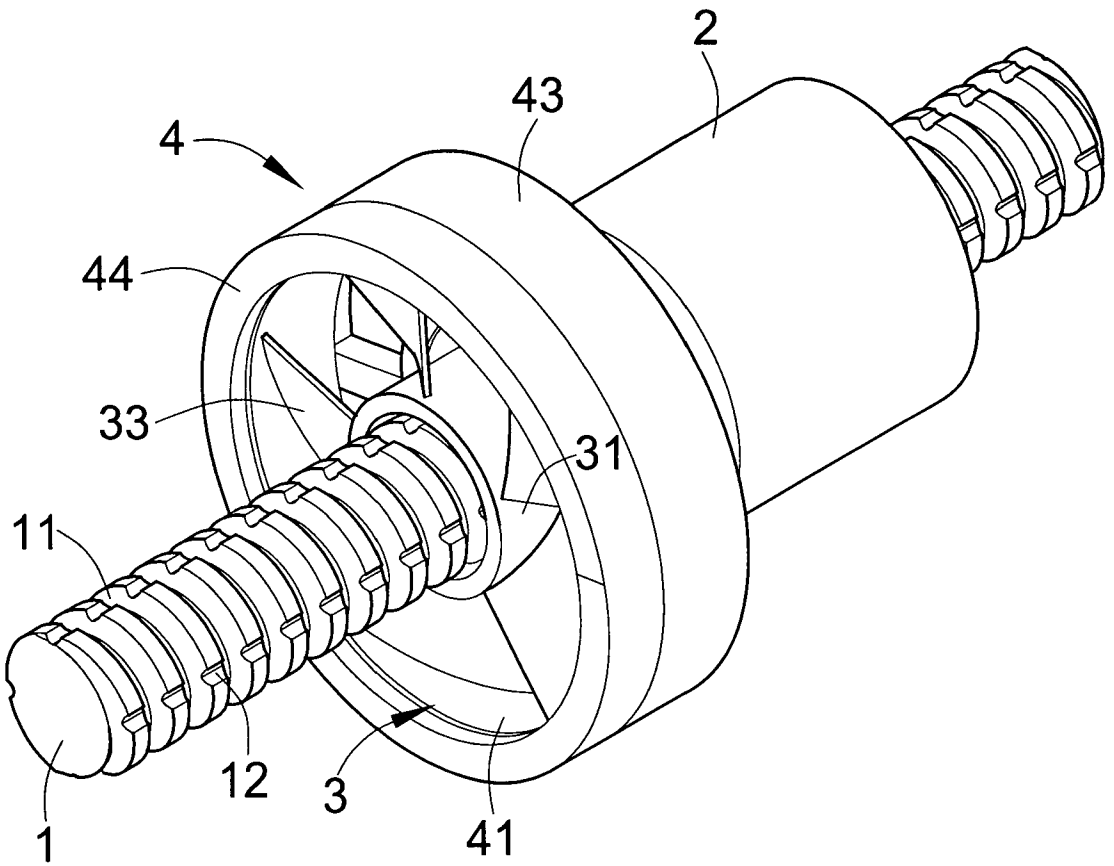
FIG. 1 is a diagram of an example embodiment of a screw-driven fan device.
Figure 2:
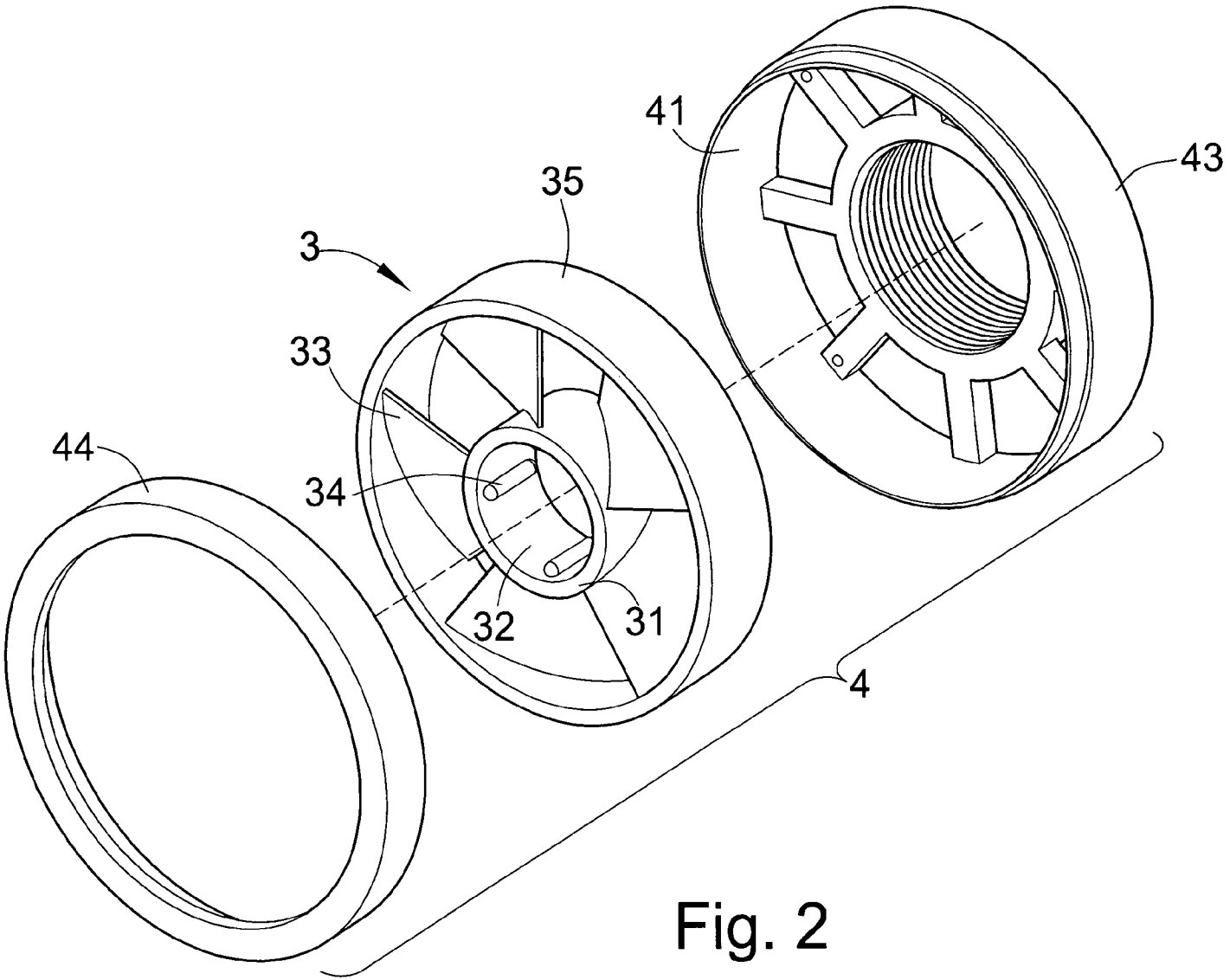
FIG. 2 is a perspective-exploded diagram of an example embodiment of fan device.
Figures 3, 3A:
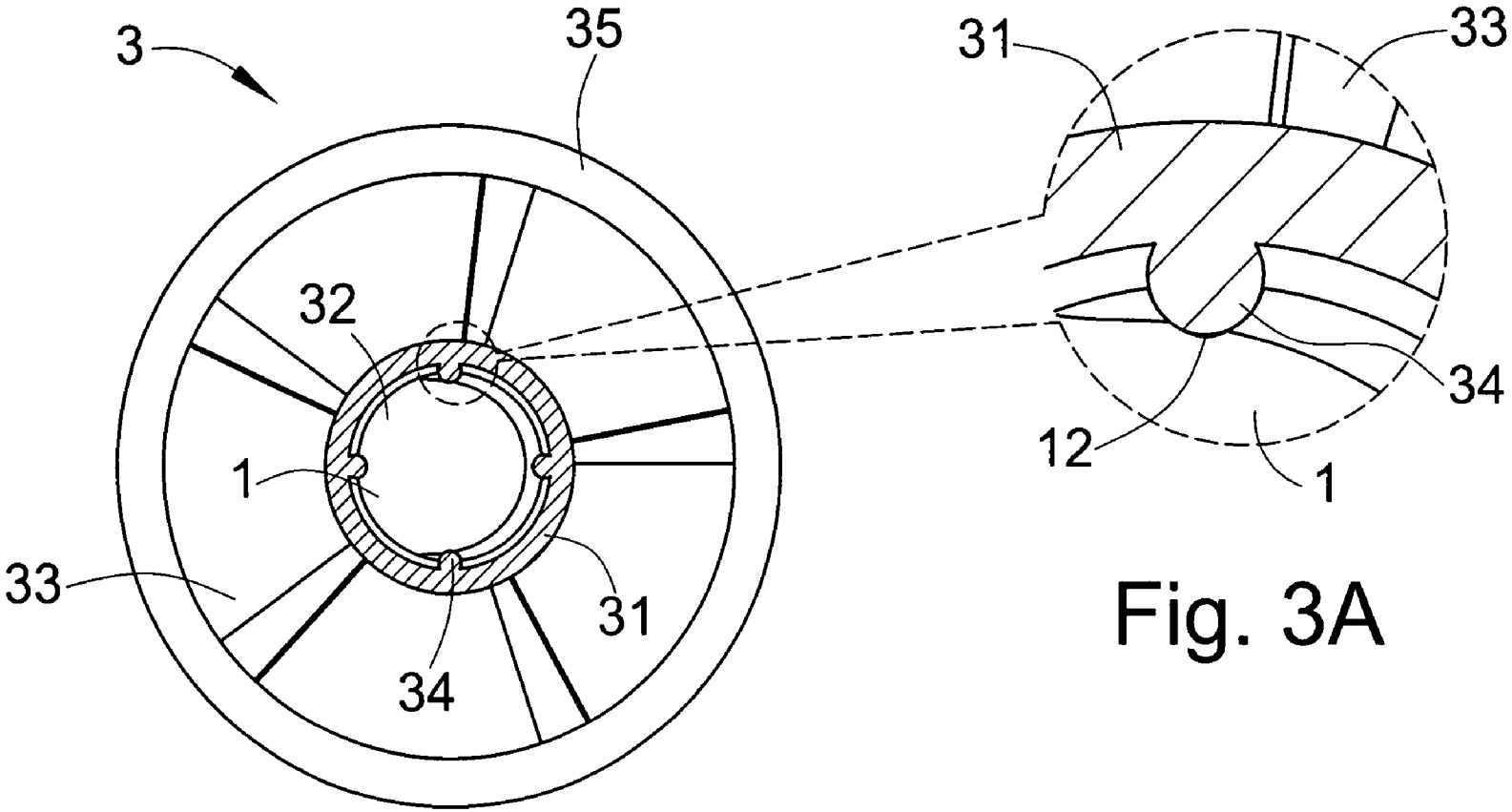
FIG. 3 is a front cross section diagram of an example embodiment of fan device.
FIG. 3A is an enlarged view of FIG. 3 showing connection of groove and flange.

Embodiments of the present disclosure will be described more fully hereinafter with reference to the accompanying drawings in which like numerals represent like elements throughout the several figures, and in which example embodiments are shown. Embodiments of the claims may, however, be embodied in many different forms and should not be construed as limited to the embodiments set forth herein. The examples set forth herein are non-limiting examples and are merely examples among other possible examples.

Please refer to FIGS. 1-4 showing an embodiment of screw-driven fan device comprising a screw 1, a screw nut 2, a fan 3, and a connecting unit 4.

An external edge of the screw 1 has a rolling groove 11 formed thereon and a groove 12 formed alternately with the rolling groove 11. The screw nut 2, engaged with the screw 1, has one end with a linking portion 21. The fan 3 has a rotary axle 31 with a hole 32 thereon for screw passing through. The fan 3 further has blades 33 surrounding the rotary axle 31. The hole 32 has a flange 34 formed on an interior edge thereof, and the flange 34 is engaged with the groove 12. When the screw 1 rotates, the coordination of the flange 34 and the groove 12 causes the fan 3 rotates simultaneously. The connecting unit 4 has one side mounted on the linking portion of the screw nut 2. The connecting unit 4 has a space 41 therein such that the fan 3 can be placed in the space 41, thereby the fan 3 and the screw nut 2 move together.

Figures 4, 4A:
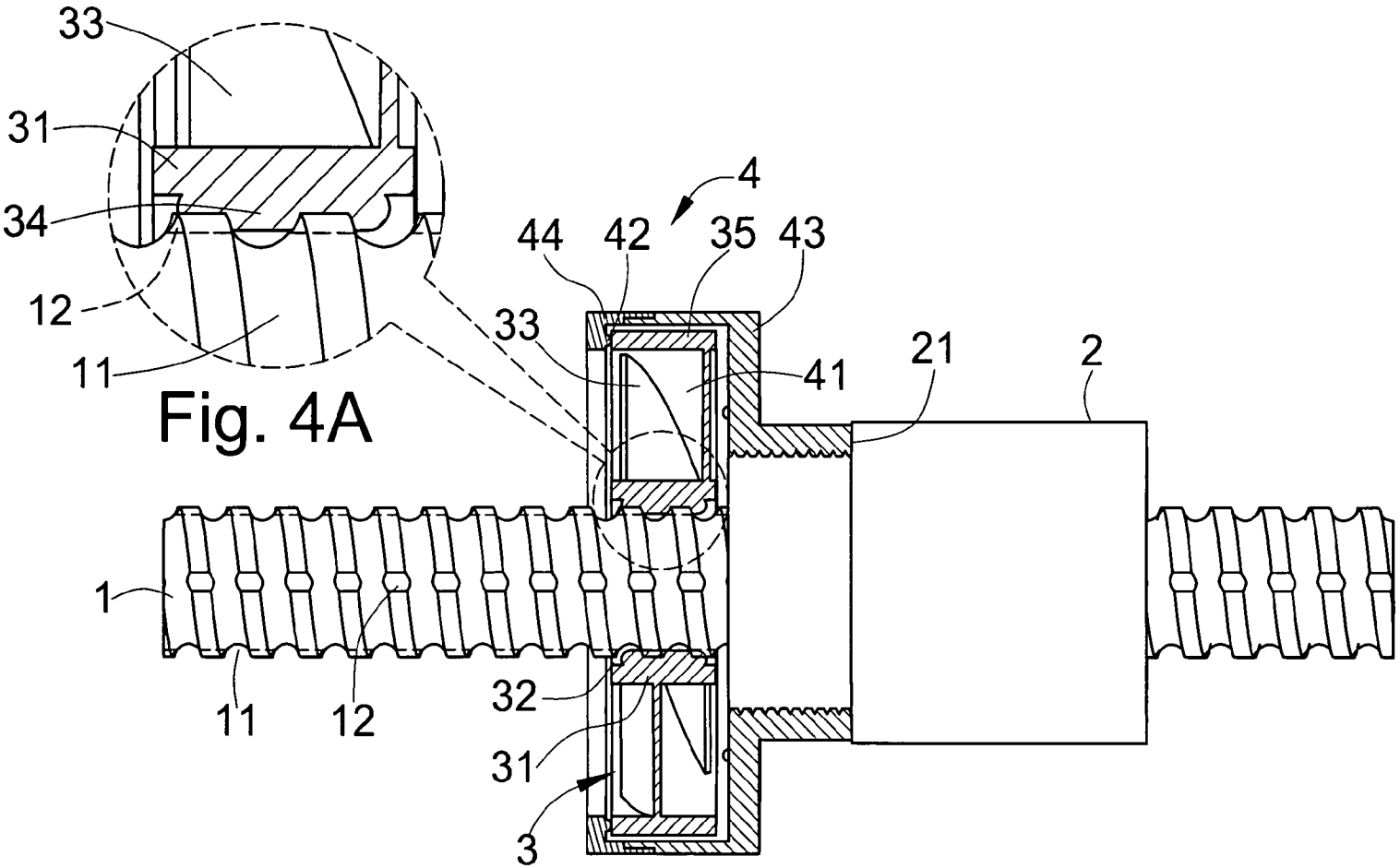
FIG. 4 is a cross-section diagram of example embodiments of a side portion of the screw-driven fan device.
FIG. 4A an enlarged view of a portion of FIG. 4.

The fan 3 and the connecting unit 4 are connected and driven as follows. The external surrounding of the blades 33 is provided with a ring 35. The space 41 of the connecting unit 4 has a blocking portion 42 formed therein, as shown in FIG. 4. The blocking portion 42 and the connecting unit 4 can be integrated into one unit, or the blocking portion 42 can be rotationally inserted in the connecting unit 4 and disposed on two sides of the ring 35. The connecting unit 4 is used for restricting movement of the fan 3 such that the fan 3 is moved with respect to the screw nut 2. The connecting unit 4 cannot restrict the rotation of the blades 33. Accordingly, the blocking portion 42 merely leans against two sides of the ring 35.

Moreover, the connecting unit 4 further comprises a base 43 and a cover 44. The base 43 and the cover 44 are engaged from two opposite sides of the fan 3 to encompass the fan 3. The blocking portion 42 is integrated or rotationally engaged with the base 43 or the cover 44.

Furthermore, to prevent excessive friction between the blocking portion 42 and the ring 35, in which the friction may hinder the rotation of the blades 33, contact area between the blocking portion 42 and the ring 35 should be reduced as much as possible. In another embodiment, the blocking portion 42 can be a rolling ball, point contacting the ring 35 such that the friction can be minimized. When the fan 3 rotates, the rolling ball rotates with the ring 35, thereby reducing friction.

Compared with the deficiency of the conventional design, the present invention provides the following advantages.

Conventional design includes (1) Utilizing cooling circulation path for heat dissipation; (2) utilizing cooling circulation to carry heat away.

Disadvantages of the conventional design are (1) difficult manufacturing procedures with high manufacturing cost; (2) possibility of cooling liquid overflow causing environmental contamination.

The present invention provides (1) fans with heat dissipation design; (2) utilizing airflow to carry heat away.

Advantages of the present invention are (1) simple and easy design with low cost; (2) natural air circulation without contamination.

Those skilled in the art will readily observe that numerous modifications and alterations of the device and method may be made while retaining the teachings of the invention.

What is claimed is:

1. A screw-driven fan device comprising:

a screw comprising a rolling groove on an external edge thereof, and an axial groove disposed with the rolling groove;

a screw nut, disposed on the screw, comprising a linking portion located on one end thereof;

a fan comprising a rotary axle with a hole formed thereon for the screw passing through and at least one blade surrounding the rotary axle, wherein the hole has a flange formed on an interior side thereof, and the flange is engaged with the axial groove such that when the screw rotates, the coordination of the flange and the axial groove causes the fan to rotate simultaneously with the screw; and a connecting unit having a space and one side mounted on the linking portion of the screw nut so that the screw nut is attached to the connecting unit; wherein the fan is placed in the space, wherein the fan and the screw nut move axially together.

2. The device of claim 1, wherein an exterior surrounding of the at least one blade is provided with a ring.

3. The device of claim 2, wherein the space of the connecting unit has a blocking portion formed therein, and the blocking portion is disposed on two sides of the ring.

4. The device of claim 3, wherein the blocking portion and the connecting unit are integrated into one unit.

5. The device of claim 1, wherein the connecting unit further comprises a base and a cover, and the base and the cover are engaged from two sides of the fan to encompass the fan.

* * * * *